United States Patent [19]

Pickett et al.

[11] Patent Number: 4,463,701

[45] Date of Patent: Aug. 7, 1984

[54] PARAVANE WITH AUTOMATIC DEPTH CONTROL

[75] Inventors: David M. Pickett, Clarksburg; Richard K. Knutson; William VonFeldt, both of Gaithersburg, all of Md.

[73] Assignee: The United States of America as represented by the Secretary of the Navy, Washington, D.C.

[21] Appl. No.: 125,735

[22] Filed: Feb. 28, 1980

[51] Int. Cl.[3] ..... B63B 21/00

[52] U.S. Cl. ..... 114/245; 114/331

[58] Field of Search ..... 114/244, 245, 274, 331, 114/332, 126

[56] References Cited

U.S. PATENT DOCUMENTS

| | | | |
|---|---|---|---|
| 2,709,981 | 6/1955 | Wilcoxon | 114/245 |
| 3,703,876 | 11/1972 | Michelsen | 114/244 |
| 3,842,770 | 10/1974 | Hedbawny et al. | 114/245 X |
| 4,019,453 | 4/1977 | Boswell | 114/245 |
| 4,215,862 | 8/1980 | Yoshikawa et al. | 114/245 X |

*Primary Examiner*—Trygve M. Blix
*Assistant Examiner*—Stephen P. Avila
*Attorney, Agent, or Firm*—R. F. Beers; L. A. Marsh

[57] ABSTRACT

A paravane includes an elongated fuselage; a wing section of spaced wing members attached to an intermediate portion of the fuselage; stabilizer fins for maintaining the paravane lined-up with the direction of tow; a depth control flap positioned adjacent the wing section and having a pivot axis extending closely adjacent to the towing point; and depth control means for controlling the position of the control flap. The wing members have a straight leading edge portion, a straight trailing edge portion and a curved intermediate portion wherein the wing members are arranged such that the chord lines extend at oblique angles with the longitudinal axis of the fuselage and such that the resultant hydrodynamic lift force vector acting on the wing section passes through the tow point.

15 Claims, 6 Drawing Figures

PARAVANE WITH AUTOMATIC DEPTH CONTROL

The invention described herein may be manufactured and used by or for the Government of the United States of America for governmental purposes without the payment of any royalties thereon or therefor.

BACKGROUND OF THE INVENTION

The present invention generally relates to paravanes and other underwater towed apparatus and more particularly to paravanes having wing sections with high lift-to-drag and high lift-to-weight ratios and provided with means for maintaining the paravanes at a predetermined ordered depth.

Generally, paravanes towed by minesweepers are connected to a cable system so that the paravanes are positioned behind and laterally offset from the tow point of the minesweeper to maximize the sweep area. Various depth control means have been utilized to maintain the paravanes at a predetermined depth. One type of depth control means utilizes a float device with a length of cable extending between the float and the paravane such that the operating depth of the paravane is controlled by changing the length of the cable. However, the cable length often limits the effective working depth, and the float and cable assembly tends to impose undesirable drag forces on the towing vessel. Another depth control means which overcomes some of the drawbacks with the abovementioned float controls utilizes a depth sensor which is coupled with a rudder or control flap, the movement of which causes the paravane to ascend or descend. However, some of these depth control means as utilized in conventional paravane construction have caused the paravane to oscillate excessively or "hunt" in the water in finding the equilibrium position at the desired working depth. Such oscillating action produces dynamic loads and undesirable stresses in the cable system.

Paravanes and other underwater apparatus which include various depth control means are generally exemplified by U.S. Pat. Nos. 2,709,981; 2,879,737; 2,981,220; 3,560,912; and 3,703,876.

SUMMARY OF THE INVENTION

The present invention overcomes many drawbacks of the prior art by providing a compact, efficient paravane having a high lift coefficient, a low drag coefficient, good stability over a wide range of towing speeds and means for preventing undesired roll motions. This is generally accomplished by attaching a wing section of highly efficient staggered wing members to the fuselage such that the resultant lift force vector for the wing section is favorably arranged with respect to the towing point. The internal space of the fuselage is optimized to accommodate various power and control means as well as lightweight ballasting materials so that the paravane can be made almost neutrally buoyant. Counterweight means can be attached to one of the wing members so that the wing section assumes a vertical orientation in the water. Horizontal and lateral stabilizers are attached to the tail end portion of the fuselage to provide the paravane with stability against pitching and yawing motions. A pivotal control flap is positioned relative to the wing section such that a high degree of roll motion is generated for small deflections of the control flap. Depth control means containing a roll override feature for preventing roll motions greater than a preselected value are provided which enable the paravane to operate with a high degree of stability.

Accordingly, it is an object of the present invention to provide a simple, yet efficient towed underwater apparatus capable of achieving and maintaining a controlled depth, possessing a high degree of stability, and which may be manufactured inexpensively and does not require skilled personnel to operate.

Another object of this invention is the provision of a towed underwater device which develops a high outward lift force relative to its size and buoyancy in water and which is capable of seeking and maintaining a predetermined depth and towing orientation.

A further object of the present invention is to provide a towed underwater apparatus which is highly stable over a wide range of speeds and which is capable of assuming a predetermined orientation irregardless of its initial position.

Yet another object of this invention is to provide a towed underwater apparatus which includes means for stabilizing the apparatus with respect to undesirable rolling, yawing and pitching actions and means for enabling the paravane to maintain a predetermined depth without undue stress on the towing apparatus.

Still another object of the present invention is to provide a towed underwater apparatus which utilizes depth control means, whereby a large vertical lift force can be generated to support the weight of the towing cable and attached devices so that depth can be maintained even at a low towing speed.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may be best understood by reference to the following description taken in connection with the accompanying drawings, in which:

DETAILED DESCRIPTION OF THE DRAWINGS

Figure 1:
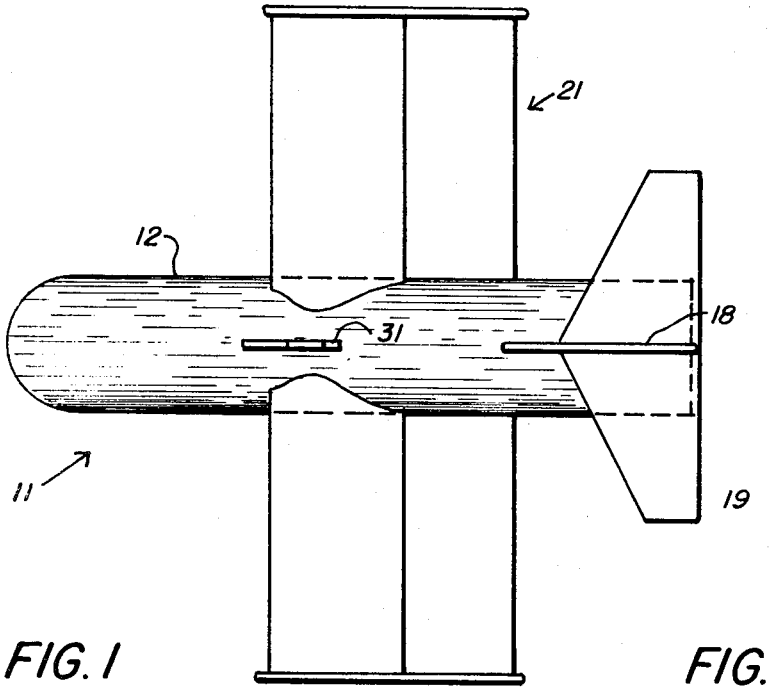
FIG. 1 is a side view of the paravane in its normal operating position.
Figure 2:
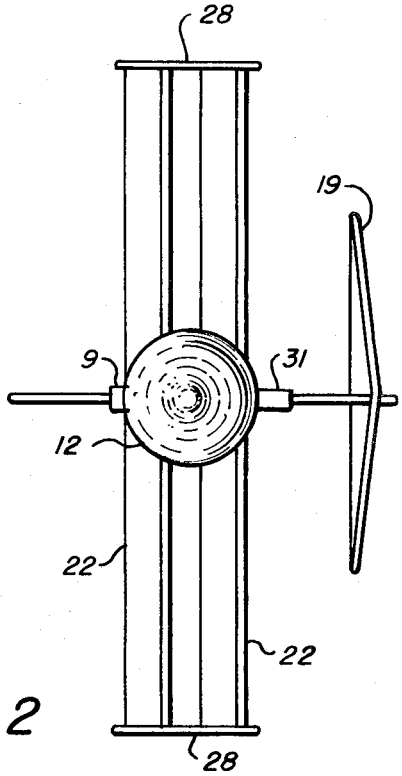
FIG. 2 is a front view of the paravane of FIG. 1.
Figure 3:
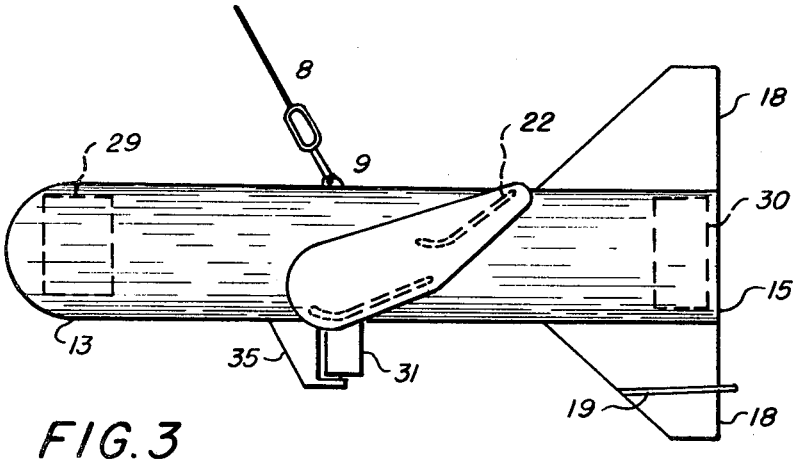
FIG. 3 is a plan view of the paravane of FIG. 1.

Referring now to the drawings, wherein like reference characters designate corresponding parts throughout the several figures, and particularly to FIGS. 1 through 3, there is shown a paravane 11 attached to a towing cable 8 (see FIG. 3). The paravane 11, which resembles a biplane, includes a cylindrical fuselage 12 or body; a wing section 21 of spaced wing members 22 secured to the central portion 14 of the fuselage 12; and a control flap 31 pivotally connected to the fuselage 12 and extending generally normal to the planes defined by the wing members 22. A lateral stabilizer 18 is attached to the tail portion 15 of the fuselage 12 and extends in a generally perpendicular relationship with the planes defined by the wing members 22 for maintaining the fuselage 12 at a proper operating orientation in the water. The paravane 11 further includes a longitudinal stabilizer 19 secured to one portion of the lateral stabilizer 18 for maintaining the wing members 22 correctly lined up with the flow.

As generally shown in FIGS. 1 through 3, the fuselage 12, which may be formed of a lightweight yet strong material such as aluminum or reinforced plastic, comprises an elongated tubular casing having a hemispherical nose portion 13 for maximizing the internal volume of the fuselage 12 and for providing a streamlined profile in the water. Such internal void spaces not only serve to accommodate depth control means and other devices, but the void spaces may be ballasted with various lightweight materials, such as syntatic foam, such that the paravane 12 will be neutrally buoyant in water and balanced about one or more symmetrical axes. Lightweight syntatic foam materials commonly include glass microspheres interposed within an epoxy matrix, wherein the material is capable of withstanding large hydrostatic pressures applied thereto and it does not absorb appreciable amounts of water. Thus, by making the paravane 12 neutrally buoyant in water and distributing the weight about one or more axes, small counterweights may be applied to a tip of one wing member 22, for example, to cause the wing members 22 to assume a vertical position when placed in the water. Additionally, the paravane 11, when nearly neutrally buoyant, can be towed at extremely slow speeds at a predetermined depth since the resultant weight component, which would ordinarily cause the paravane 11 to sink at slow towing speeds, is nearly zero. It is further understood that small weight elements may be added to or removed from the paravane 11 so that the buoyancy of the paravane 11 can be adjusted.

To facilitate access to equipment located in the interior of the fuselage 12, the nose 13 and/or the tail portion 15 may be constructed for easy removal. For example, access to a depth control means as represented by a box 29, which is shown in broken lines in FIG. 1, may be achieved by unscrewing the nose portion 13 from the central portion 14 of the fuselage 12. Similarly, a power unit such as a battery or impeller turbine 30, shown generally by broken lines in FIG. 1 and designed to supply electricity to the depth control means 29, may be attached to the tail portion 15 of the fuselage 12.

Figure 5:
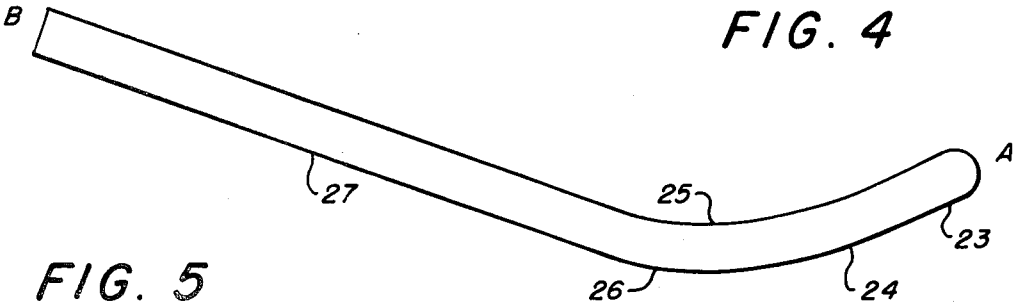
FIG. 5 is a sectional view of a wing member.

The wing section 21, which preferably comprises pairs of spaced wing members 22 arranged in the form of a biplane as depicted in the drawings, is attached to the central portion 14 of the fuselage 12. The individual wing members 22 are shaped to provide a highly efficient lift force and, as shown in FIG. 5, each wing member 22 includes a straight leading edge portion 23, a curved intermediate portion 24 and a straight trailing edge portion 27. The leading edge 23 serves as an "entrance" surface for the water flow that tends to prevent flow separation between the water and the wing member 22. The intermediate portion 24 is curved so that the flow along the convex surface 26 is accelerated while the flow across the concave surface 25 is reduced, thereby causing a large pressure differential therebetween and generating the resultant lift force for the wing member 22. The straight trailing edge portion 27 serves to prevent flow separation between the water flow and the wing member 22. The relative dimensions of the leading edge portion 23, the intermediate portion 24, and the trailing edge portion 27 are such that the resultant lift force vector acting on a given wing member 22 is positioned to pass through the intermediate portion 24 of the wing member 22.

For an efficient wing design it was found that the position of maximum camber should occur at or close to the center of the resultant force vector acting on the wing member 22. The camber line of the wing member is defined as the line which extends along the centerline of the wing member 22 from point A to point B, as shown in FIG. 5, and the chord line is defined as the shortest line which can be drawn from point A to point B. The camber for the wing is the perpendicular distance from the camber line to the chord line. For the particular wing member 22 shown in FIG. 5, the position of maximum camber should be located between 30% to 40% and preferably between 33% and 35% of the distance between points A and B, as measured from point A on the leading edge 23. It has been observed that when the position of maximum camber varies widely from the abovementioned location, the resultant lift forces on the wing member 22 will vary widely and/or erratically, with undesirable motions such as pitching moments being imparted to the wing members 22. In a particular example of an efficient wing design, the chord line from point A to point B in FIG. 5 was 6.75 inches and the point of maximum camber occurred at a distance of 2.25 inches from point A. The length ratio of the leading edge portion 23 to the trailing edge portion 27 was 1:10 with the leading edge 23 having a length of about 0.42 inches and the trailing edge portion 27 having a length of about 4.10 inches. The intermediate portion 24 of the wing member subtends an arc of 42° with a radius of curvature of approximately 3.09 inches as measured at the convex surface 26. The wing member 22 was formed with a constant thickness of 0.375 inches to facilitate economical and easy fabrication.

Figure 4:
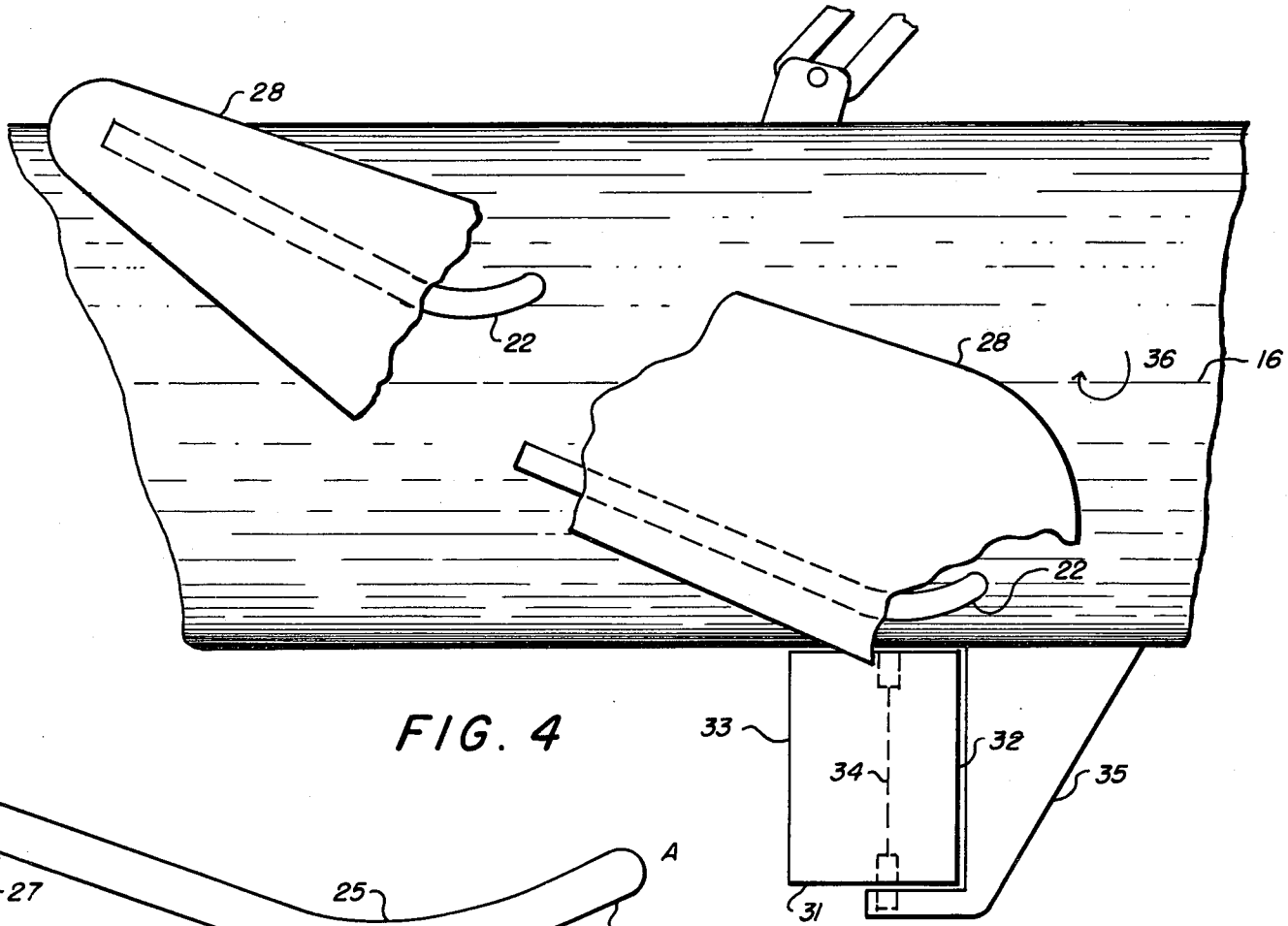
FIG. 4 is a sectional view, partially broken away, of the paravane, depicting the wing members and the control flap.

By using two wing members 22, disposed at a suitable angle to the longitudinal axis of the paravane 11 and arranged in a staggered pattern, a biplane effect is produced which is highly efficient in creating the hydrodynamic lift necessary to maintain the paravane 11 at the desired depth and lateral offset from the towed vessel. Such arrangement thereby serves to delay the flow separation between the wing members 22 and the water flow so that the resulting wing envelope is relatively small for the high lift forces and low drag forces generated by the wing section 21. It was observed, for example, that the total lift force produced by a wing section 21 at various towing speeds was greater than the sum of the lift forces produced by individual wing members of equivalent area. To provide further efficiency and operational stability, the wing members 22 should be arranged such that the resultant hydrodynamic lift force vector for the wing section 21 passes through the towing point 9. For the particular wing section 21 shown in FIG. 4, this is accomplished by separating the upper and lower wing members 22 in a direction perpendicular to the longitudinal axis 16 of the fuselage 12 by approximately one-third of the chord distance of the wing member 22 wherein the longitudinal separation parallel to longitudinal axis 12 is approximately one chord dimension of the wing member 22. The lower wing member is tilted with respect to the longitudinal axis 16 of the fuselage 12 such that the plane defined by the trailing edge portion 27 of the wing member 22 extends at an angle of about 24° thereto. Also, the upper wing member in FIG. 4, is tilted at a relative angle of 6° to the lower wing member and the trailing edge portion 27 of the upper wing member extends at an angle of about 30° with the longitudinal axis 16 of the fuselage 12. Thus, the chord lines of the upper and lower wing members 22 in FIG. 4, will form oblique angles of 18° and 13°, respectively, with the longitudinal axis 16 of the fuselage 12. Preferably, such oblique angles will be from about 10° to about 24°. A paravane 11 of the foregoing compact, efficient design was found to have a lift coefficient of about 1.5 and a drag coefficient of about 0.4.

End plates 28 as shown in the various figures, interconnect the wing members 22 and enhance the lift force acting on the wing members 22 by preventing pressure leakage (e.g. water flow) around the tips of the wing members 22. The end plates 28 also serve as a ballasting means wherein one of the end plates 28 may be made heavier than the other end plate 28 to cause the wing section 21 to assume a vertical position in the water as shown in FIGS. 1 and 2.

A lateral stabilizer 18, which comprises two equal area fin portions balanced about the longitudinal axis 16 of the fuselage 12, serves to maintain the fuselage 12 lined up with the towing direction and to minimize undesirable dynamic motions such as lateral yaw-roll coupling. In describing movements of the paravane about a coordinate system defined by a yaw, a rolling and a pitching axis, the yaw axis will be defined by a line which is both normal to the longitudinal axis 16 of the fuselage 12 and the plane generally defined by the wing members 22. The pitch axis is defined by a line which is parallel to the plane encompassed by the wing members 22 and normal to the longitudinal axis 16 of the fuselage 12. Further, the roll axis is defined as being parallel and most probably coincident with the longitudinal axis 16 of the fuselage 12. A lateral deflection is defined as a displacement which occurs within a plane generally defined by the wing members 22 and a longitudinal deflection will be defined as a displacement which occurs in a direction which is perpendicular to the plane defined by the wing members 22. Thus, the lateral stabilizer tends to reduce movements of the paravane 11 about the yaw axis and the roll axis as well as minimizing relative lateral displacements of the tail portion 15 from the towing direction.

A longitudinal stabilizer 19 is secured to one of the lateral stabilizers, as generally shown in FIGS. 1–3, to reduce pitching motions and to minimize lateral displacements of the tail portion 15 of the fuselage 12. The longitudinal stabilizer 19 has been located to minimize the flow interference from the wing members 22 and means are provided for adjusting the position of the longitudinal stabilizer 19 to vary the wing lift. This is generally accomplished by pivoting the longitudinal stabilizer 19 about an axis which extends normal to the lateral stabilizer 18 and subsequently securing the stabilizer 19 in a fixed position.

The mechanical means for controlling the depth of the paravane comprises a control flap 31 which is pivoted to move about an axis 34 that is perpendicular to the wing members 22 and parallel to the lateral stabilizer 18. The control flap 31 is located relative to the wing section 21 and the tow point 9 such that deflection of the control flap 31 will impart a high degree of roll but a minimal amount of yaw motion. This roll motion will thereby cause wing members 22 which are normally oriented in a vertical direction to tilt from such position so that a large vertical force component is generated on the wing members 22 to cause the paravane 11 to move in a predetermined direction. Thus, the control flap 31, as shown in FIG. 4, causes an efficient and rapid depth response for small deflections of the control flap 31. In FIG. 4, for example, a deflection of the control flap 31 wherein the trailing edge portion 33 goes into the drawing would cause a clockwise rotation of the paravane 11, as viewed from the front end of the paravane 11 and as depicted by the arc 36 in FIG. 4. Accordingly, as the paravane 11 begins to roll in such a clockwise fashion, the vertical force component developed on the wing members 22 causes the paravane 11 to rise in the water. When the paravane 11 reaches a predetermined depth, the flap 31 returns to the neutral, undeflected position. A tapered horn member 35 is positioned forward of the control flap 31 to prevent damage thereto and fouling thereof with cables and marine vegetation. For minimizing the torque required to pivot the control flap, it was determined that the pivot axis 34 for the control flap 31 should be located at about 33% of the flap chord from the leading edge 32 of the control flap 31. Thus, by positioning the control flap 31 close to the wing section 21 to take advantage of the accelerated flow conditions and having the pivot axis 34 of the control flap 31 extend closely adjacent to the tow point 9, a highly efficient depth control is achieved wherein adverse yaw-roll coupling effects are minimized.

Figure 6:
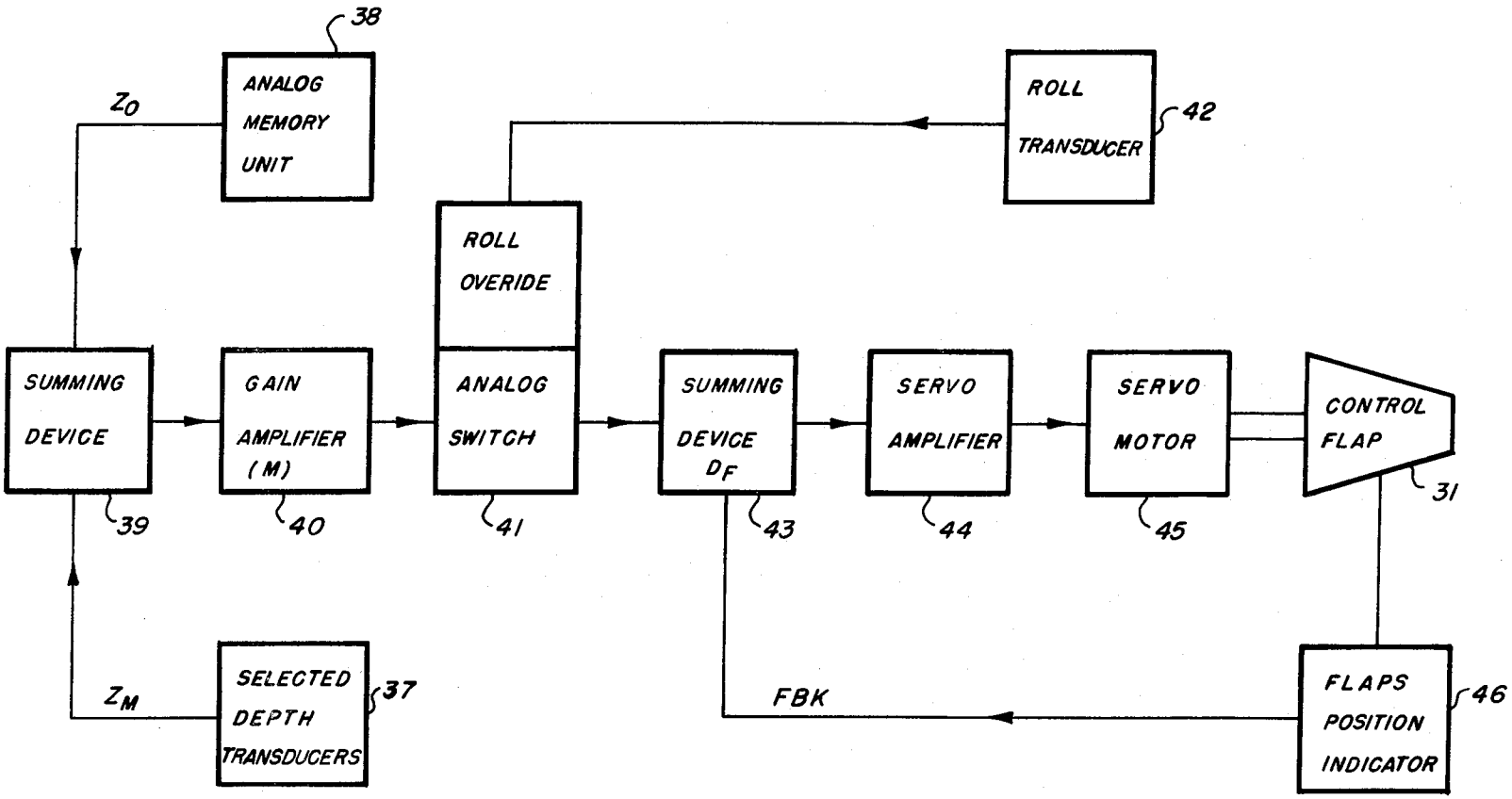
FIG. 6 is a diagram of the depth control system employed in the paravane.

Means for controlling the position of the control flap 31 and thus the depth of the paravane 11 is generally shown in FIG. 6, wherein the basic components include low and high range depth gauges; an analog memory unit containing an ordered depth parameter; a DC servo motor; a roll pendulum potentiometer, hereinafter referred to as a roll transducer; and other electrical apparatus. Two types of depth gauges 37 are utilized to obtain the required accuracy throughout the depth range of the paravane, wherein the depth gauges (of the pressure transducer type) 37 are positioned in the fuselage 12 so that the dynamic pressure due to the flow of water is at a minimum or zero. To protect the low pressure gauge at great depths, a blanking valve can be built into the pressure gauges. The depth measured by the pressure gauge or transducer 37, such as model Z-625 made by Sencotec, is converted into an electrical voltage (Zm) which is proportional to the measured depth.

The analog memory unit 38, such as unipolar unit EUWAOC made by Natsushita Ltd. of Osaka, Japan, is used to establish an ordered depth voltage (Zo). The reference or ordered depth voltage (Zo) is applied to the analog memory unit 38 through a separate calibration module and when the module is unplugged from the paravane 11, the reference voltage (Zo) is retained in the analog memory unit 38. Thereafter, when the paravane 11 is operating, the measured depth (Zm) and ordered depth (Zo) values are constantly being compared in a summing device 39. The error value or the voltage difference between Zm and Zo is then amplified by the gain amplifier 40, such as Operational Amplifier MC-3403 made by Motorola, Inc.

Thereafter, the amplified voltage M(Zo−Zm) is applied to an analog switch 41, such as Quad Analog Gate 1 H 5009 manufactured by Intersil, a division of Datel, Inc. The analog switch 41 functions as an override switch so that if the wing members 22 roll more than 45°, for example, from a vertical position, as measured by the roll transducer 42, the roll override unit 47 sends an appropriate signal to the analog switch 41 such that the signal M(Zo−Zm) from the gain amplifier 40 is blocked and an appropriate signal from the analog switch 41 is sent to a second summing device 43 such that the control flap 31 is returned to a neutral position. The oil damped roll transducer 42, such as model CT 17,1303-3 made by Humphrey, Inc., and associated roll override circuitry 47 is employed to prevent the paravane 11 from rolling completely over when the control flap 31 is deflected. For example, when the paravane 11 is initially deployed, the large difference in the values Zo, Zm would ordinarily cause a large deflection of the control flap 31 and result in large rolling moments. If uncontrolled, the paravane 11 would continue to roll over, as in a tailspin, and eventual fouling of the paravane 11 in the towing cables 8 or damage thereto may result.

If the roll override logic in the analog switch 41 has not been activated, the value M(Zo−Zm) from the gain amplifier 40 is sent through the analog switch 41 to a second summing device 43 wherein a fin position feedback value (FBK) is added therewith. The fin position indicator 46 functions essentially as a potentiometer where a deflection of the control flap 31 in one direction is accompanied by a negative FBK value and a deflection of the control flap 31 in the other direction is reflected in a positive FBK value. The second summing device 43 sends the resultant signal ($D_F$) to a servo amplifier 44 and the DC servo motor 45. The second summing device 43, servo amplifier 44, servo motor 45 and fin position indicator 46 are arranged to rotate the control flap 31 until the value of $D_F$ is zero, wherein $D_F = M(Zo - Zm) - FBK$.

Obviously many modifications and variations of the present invention are possible in light of the above teachings. It is therefore to be understood that within the scope of the following claims the invention may be practiced otherwise than as specifically described.

What is claimed is:

1. A towed underwater apparatus comprises:

an elongated fuselage portion;

a wing section of elongated spaced wing members attached to the fuselage, each wing member includes a convex surface and means to reduce fluid flow separation adjacent the wing members;

stability means attached to the fuselage for maintaining the fuselage lined up with the direction of tow;

a depth control flap positioned adjacent to the wing section and pivotally connected to the fuselage so that the leading edge of the flap is disposed beneath and closely adjacent to the leading edge of the wing section; and a depth control means located within the fuselage and connected to the control flap, the depth control means is operable in response to the hydrostatic pressure for controlling the position of the control flap.

2. The apparatus according to claim 1, wherein each said wing member includes a straight leading edge portion, a straight trailing edge portion and a curved intermediate portion.

3. The apparatus according to claim 2, wherein the ratio of the length of said trailing edge portion to said leading edge portion is 10:1.

4. The apparatus according to claim 2, further comprising end plates interconnecting the end portions of said wing members remote from said fuselage and said end plates extending generally parallel with said fuselage.

5. The apparatus according to claim 2, wherein said fuselage has a longitudinal axis and said trailing edge portions of said wing members lie within a plane which forms an oblique angle with said longitudinal axis of said fuselage.

6. The apparatus according to claim 5, wherein said oblique angle is between about 20° and 33°.

7. The apparatus according to claim 2, wherein said trailing edge portions of adjacent wing members lie within planes which define angles therebetween of from about 4° to about 10°.

8. The apparatus according to claim 1, wherein said fuselage has a longitudinal axis and each wing member is longitudinally offset from the adjacent wing member by the chord length of a selected wing member.

9. The apparatus according to claim 1, wherein said fuselage has a longitudinal axis and each said wing member is separated in a direction perpendicular to the longitudinal axis of the fuselage by approximately one third of the chord distance of the wing member and wherein the longitudinal separation parallel to longitudinal axis is approximately one chord dimension of the wing member.

10. The apparatus according to claim 1, wherein:

said stability means comprises a lateral stabilizer fin secured to the tail end portion of said fuselage and extending generally normal to said wing section for maintaining said fuselage lined up with the towing direction; and a longitudinal stabilizer fin connected to said lateral stabilizer and extending generally normal thereto, said stabilizer fin being adjustable to vary the resultant hydrodynamic lift force vector on said wing section.

11. The apparatus according to claim 1, further comprising:

a towing mount attached to said fuselage for receiving a towing cable; and said depth control flap has a pivot axis which extends closely adjacent to said towing mount for minimizing yaw-roll coupling motions when said control flap is pivoted from a neutral position.

12. A towed underwater apparatus comprises:

an elongated fuselage portion;

a wing section of elongated spaced wing members attached to the intermediate portion of the fuselage;

a depth control flap positioned adjacent to the wing section and pivotally connected to the intermediate portion of the fuselage;

a tow mount for receiving a towing cable is secured to the intermediate portion of the fuselage adjacent to the wing section, on the opposite side of the fuselage from the depth control flap, and generally opposite to the depth control flap;

stability means attached to the fuselage for maintaining the fuselage lined up with the direction of tow; and a depth control means located within the fuselage and connected to the control flap, the depth control means is operable in response to hydrostatic pressure for controlling the position of the control flap.

13. A towed underwater apparatus comprises:

an elongated fuselage portion;

a wing section of elongated spaced wing members attached to the fuselage, each wing member includes a convex surface and means to reduce fluid flow separation adjacent the wing members;

stability means attached to the fuselage for maintaining the fuselage lined up with the direction of tow;

a depth control flap pivotally connected to the fuselage;

a tow mount attached to the fuselage for receiving a towing cable, the tow mount is located so that the resultant hydrodynamic lift force vector acting on the wing section during towing operations is lined up with the tow mount; and a depth control means located within the fuselage and connected to the control flap, the depth control means is operable in response to hydrostatic pressure for controlling the position of the control flap.

14. A towed underwater apparatus comprises:

an elongated fuselage portion having a longitudinal axis;

a wing section of elongated spaced wing members attached to the fuselage, each wing member includes a convex surface portion and means to reduce fluid flow separation adjacent the wing members;

stability means attached to the fuselage for maintaining the fuselage lined up with the direction of tow;

a depth control flap pivotally connected to the fuselage; and a depth control means located within the fuselage and connected to the control flap, the depth control means is operable in response to hydrostatic pressure for controlling the position of the control flap, the depth control means includes a roll override means responsive to a predetermined amount of tilt of the wing section from a vertical position during towing operation to return the control flap to a neutral, undeflected position wherein the control flap lies in a plane which is generally parallel with the longitudinal axis.

15. A towed underwater apparatus comprises:

an elongated fuselage;

a wing section of spaced wing members attached to the fuselage, each wing member includes a straight leading edge portion, a straight trailing edge portion, and a curved intermediate portion, wherein the ratio of the length of said trailing edge portion to said leading edge portion is about 10:1;

a depth control flap pivotally connected to the fuselage and located adjacent the wing section;

stability means attached to the fuselage for maintaining the fuselage lined up with the direction of tow; and depth control means located within the fuselage and connected to the control flap, the depth control means is operable in response to hydrostatic pressure for controlling the position of the control flap.

* * * * *